US008566978B2

(12) United States Patent
Tabbia

(10) Patent No.: US 8,566,978 B2
(45) Date of Patent: Oct. 29, 2013

(54) CRIB SET WITH STATIONARY AND MOVEABLE CRIB

(75) Inventor: Lawrence E. Tabbia, Hernando, FL (US)

(73) Assignee: Divine Nursery Furniture LLC, Naples, FL (US)

( * ) Notice: Subject to any disclaimer, the term of this patent is extended or adjusted under 35 U.S.C. 154(b) by 0 days.

(21) Appl. No.: 13/536,094

(22) Filed: Jun. 28, 2012

(65) Prior Publication Data

US 2013/0000037 A1 Jan. 3, 2013

Related U.S. Application Data

(60) Provisional application No. 61/503,664, filed on Jul. 1, 2011.

(51) Int. Cl.
*A47D 7/00* (2006.01)
*A47D 7/02* (2006.01)
*A47D 13/06* (2006.01)

(52) U.S. Cl.
USPC ..... 5/93.1; 5/100; 5/9.1

(58) Field of Classification Search
USPC ..... 5/93.1, 93.2, 100, 2.1, 8, 9.1
See application file for complete search history.

(56) References Cited

U.S. PATENT DOCUMENTS

| | | | | | |
|---|---|---|---|---|---|
| 378,455 | A | * | 2/1888 | Morse | 5/11 |
| 1,391,566 | A | * | 9/1921 | Musselman | 5/2.1 |
| 1,577,255 | A | | 3/1926 | Hill | |
| 2,242,357 | A | * | 5/1941 | Kroll et al. | 5/100 |
| 2,247,598 | A | * | 7/1941 | Bohlen | 5/102 |
| D176,930 | S | | 2/1956 | Saba | |
| 2,783,477 | A | | 3/1957 | Tittsworth | |
| 2,888,687 | A | * | 6/1959 | Lindsey | 5/2.1 |
| 2,889,560 | A | * | 6/1959 | Carman | 5/100 |
| 3,316,564 | A | * | 5/1967 | Rogers, Jr. | 5/9.1 |
| 3,321,776 | A | * | 5/1967 | Black | 5/8 |
| 3,325,830 | A | * | 6/1967 | Black | 5/8 |
| D209,570 | S | | 12/1967 | Van Riper | |
| 3,610,716 | A | | 10/1971 | Weinberg et al. | |
| 3,649,973 | A | | 3/1972 | Benoit et al. | |
| D225,601 | S | | 12/1972 | Pierson | |
| 3,896,513 | A | * | 7/1975 | Boucher et al. | 5/99.1 |
| 4,232,411 | A | * | 11/1980 | Speyer | 5/8 |
| 4,715,075 | A | * | 12/1987 | Shamie | 5/93.1 |
| 4,811,436 | A | | 3/1989 | Schwartz | |
| 5,077,846 | A | * | 1/1992 | Wheeler et al. | 5/93.2 |
| 5,093,945 | A | | 3/1992 | Schoonover et al. | |
| 5,173,974 | A | | 12/1992 | Proano et al. | |
| 5,327,594 | A | | 7/1994 | Sun | |
| 5,502,849 | A | | 4/1996 | Mitchell | |

(Continued)

OTHER PUBLICATIONS

Windsor Cribs, Caring for your Children, American Church Furnishings, 1983 (4 pages).

*Primary Examiner* — Robert G Santos
(74) *Attorney, Agent, or Firm* — Gifford, Krass, Sprinkle, Anderson & Citkowski, P.C.

(57) ABSTRACT

A crib set including a stationary and moveable crib is provided so as to form a respective upper and lower crib housed by a cabinet-like frame. The upper crib includes a foldable gate structure for allowing access to a child therein, while the lower crib is moveable relative to the frame so as to allow overhead access to a child using the crib.

5 Claims, 3 Drawing Sheets

(56) References Cited

U.S. PATENT DOCUMENTS

| | | | | |
|---|---|---|---|---|
| D371,013 | S | 6/1996 | Smalls et al. | |
| 5,926,870 | A * | 7/1999 | Branca-Barnes et al. | 5/93.1 |
| 6,434,766 | B1 * | 8/2002 | Beddawi | 5/18.1 |
| 6,721,969 | B1 * | 4/2004 | Lupo et al. | 5/9.1 |
| 7,752,689 | B1 | 7/2010 | Shamie et al. | |
| 2002/0157180 | A1 | 10/2002 | Koenig et al. | |
| 2008/0022457 | A1 | 1/2008 | Wu | |
| 2013/0000037 | A1 * | 1/2013 | Tabbia | 5/93.1 |

* cited by examiner

CRIB SET WITH STATIONARY AND MOVEABLE CRIB

CROSS-REFERENCE TO RELATED APPLICATIONS

This application claims priority from U.S. Provisional Patent Application No. 61/503,664, filed Jul. 1, 2011, the entire disclosure of which is incorporated herein by reference.

FIELD OF THE INVENTION

The present invention relates to cribs and crib sets for infants and toddlers, and more specifically, to a crib set having a stationary and moveable crib and in which neither crib is what are termed "drop-side" crib.

BACKGROUND OF THE INVENTION

In many settings including day care centers and other institutions which maintain nurseries devoted to infant and toddler care, cribs are a mainstay used to house children while sleeping or during play.

Among many of such cribs in use today, so called drop-side cribs in which a front side or front side gate is slidable downwardly to allow access to the child is prevalent. Such cribs, however, have been found to pose unnecessary risk to children housed by the cribs as a result of the slidability of the gate. As the drop-side gate slides down to permit access to the child injuries can occur if the child's hands or legs or even its head are extending through the gate as it is lowered. As a result, recent regulations impose new standards for cribs sold in the United States which no longer permit the sale of drop-side cribs. As a result, recent regulations impose new standards for cribs sold in the United States which no longer permit the sale of drop-side cribs.

Thus, it would be advantageous to provide a crib or crib set that is of the non-drop-side type and that would be appealing to the above institutions and others for use in child care that they may offer.

SUMMARY OF THE INVENTION

Such an advantage is realized by the present invention that provides a crib and crib set without drop-side gates.

More particularly, the present invention includes a set of cribs having an upper and lower crib. Together, the cribs form a crib stack so as to be nested together in a cabinet-like frame. This of course makes the crib set advantageous in situations such as a day care center where space is at a premium. The upper crib is stationary with the frame and includes a laterally and downwardly folding front gate that is foldable outwardly from the frame so as to allow access to a child without directing the gate toward the child thereby minimizing the risk of the child being injured by the gate as it is lowered. The lower crib does not include a gate, and is rollable so as to be moveable outwardly from the frame to allow overhead access to a child therewithin.

Accordingly, the crib set of the present invention provides for and facilitates access to each of its cribs and the child therein without using a drop-side gate and, all the while, also provides a compact construction that allows for space-saving efficiency, thus making it attractive to those needing to accommodate small spaces or wishing to maximize capacity.

DETAILED DESCRIPTION OF THE PREFERRED EMBODIMENTS

Figure 1:
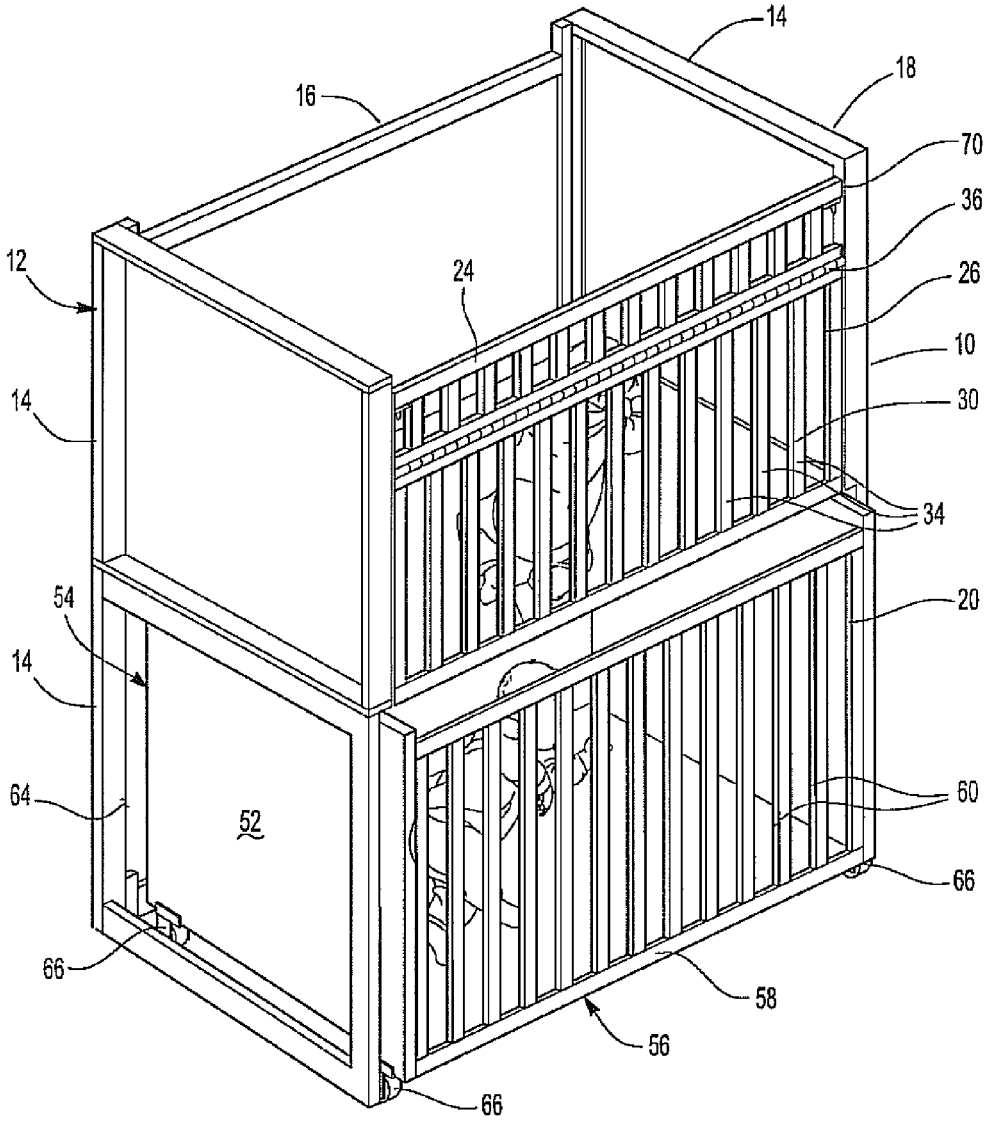
FIG. 1 is a side and perspective view of the crib set of the present invention.
Figure 2:
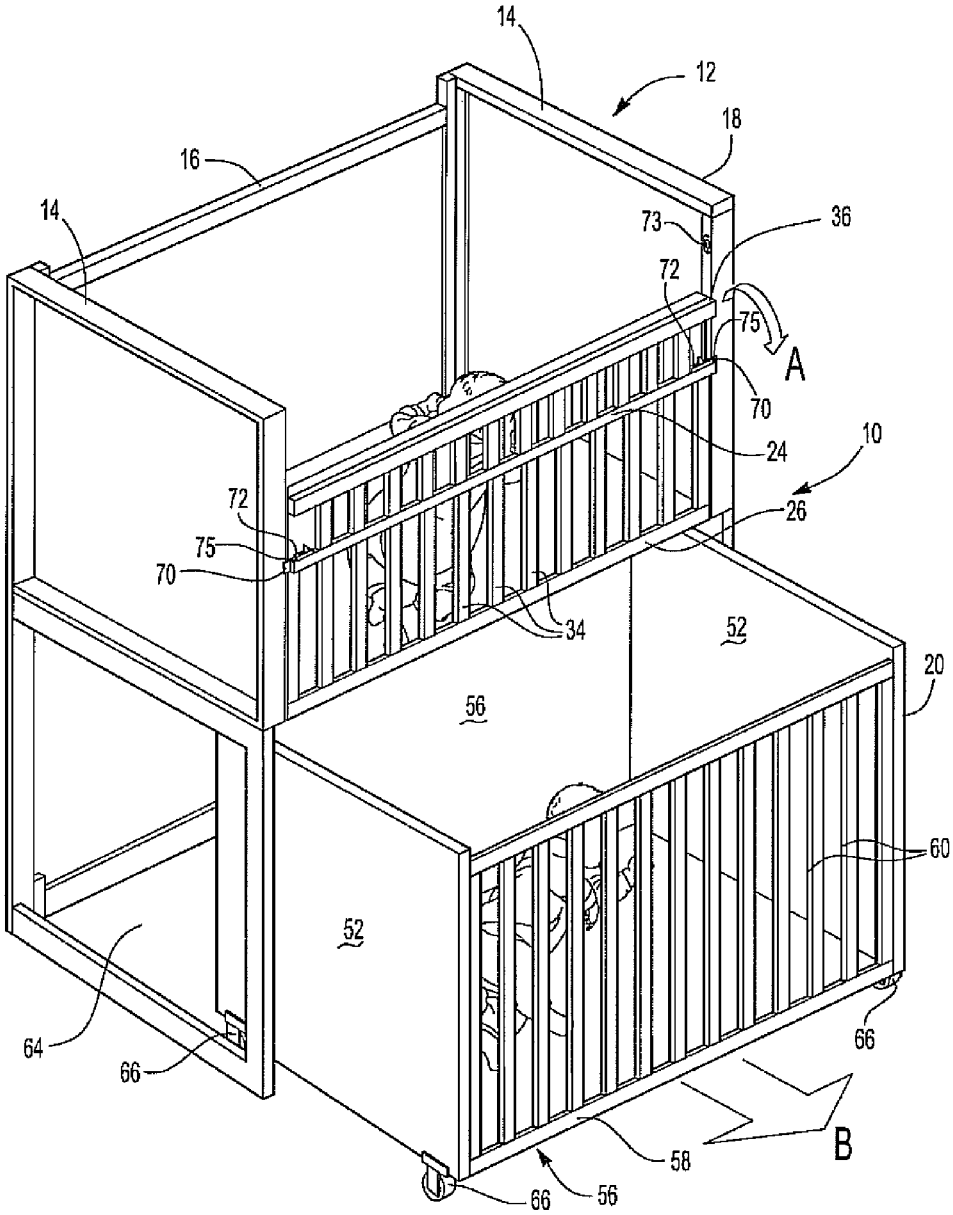
FIG. 2 is side and perspective view of the crib set according to FIG. 1 and shows the foldable gate structure of the upper crib as well as the lower crib in a separated position from the upper crib.

The present invention provides a crib set including a stationary and a moveable crib, each without drop-side gating. Referring to FIGS. 1 and 2, there is shown the crib set 10 of the present invention. Therein, a three sided cabinet-like wooden frame 12 includes opposing sides 14 and a backside 16, and serves as a housing for an upper wooden crib 18 and a lower wooden crib 20. The frame 12 is assembled using conventional fasteners such as screws (not shown) or glue, though others means of fastening such as a tongue and groove arrangement are also contemplated.

The upper crib 18 is a stationary crib and is formed by portions of the frame 12 opposing sides 14 and a backside 16, and furthermore by wooden slatted top and bottom gate sections 24, 26 positioned at, and serving as, the front of the upper crib 18. The frame 12 is also provided with a base portion 30 serving as a floor of the upper crib 18 so as support a mattress or pad (not shown) on which a child may be accommodated.

Each of the gate sections 24, 26 comprises a series of equally spaced slats 34 sized to prevent passage of the torso, legs and head of a child.

Figure 3:
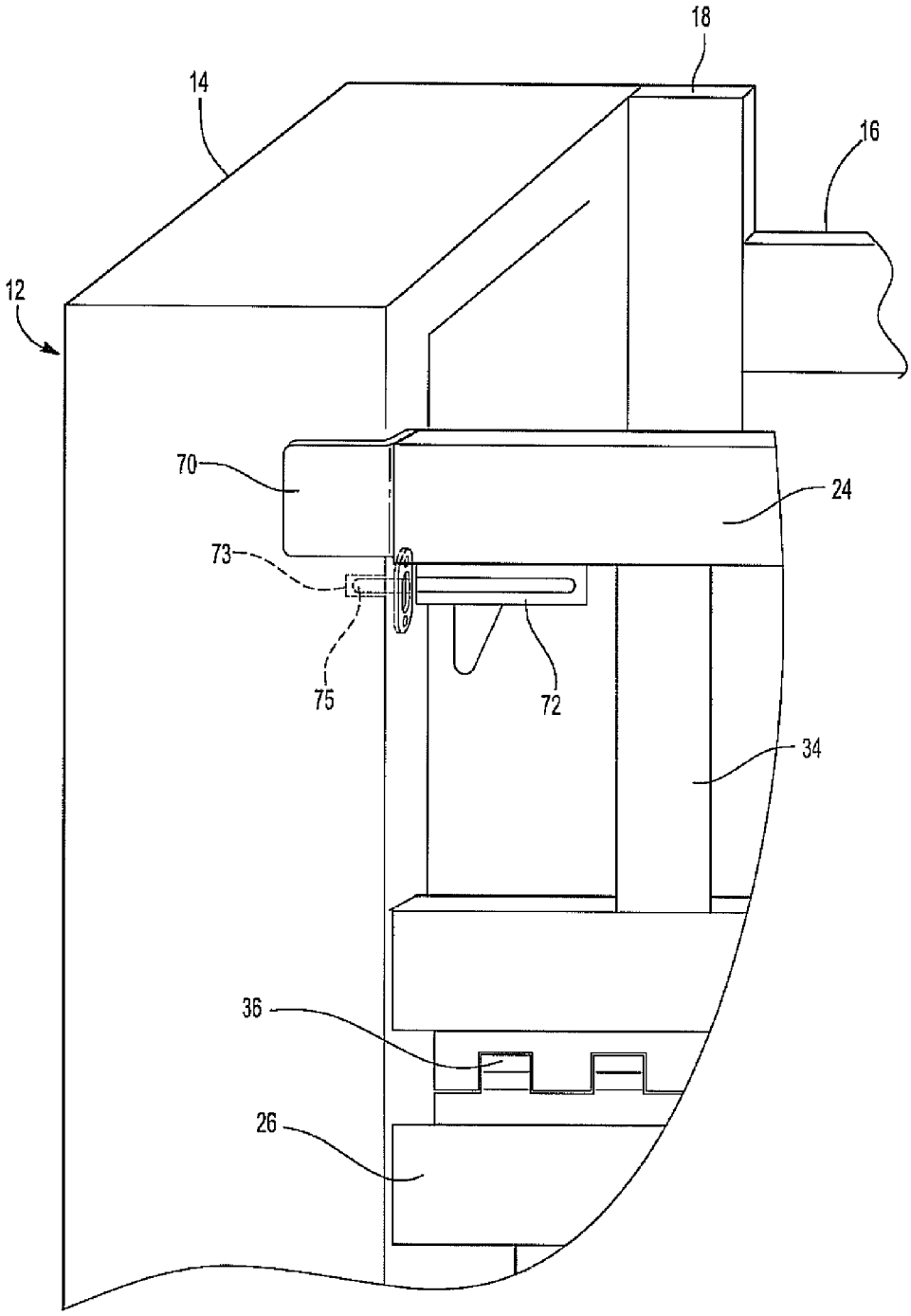
FIG. 3 is a fragmentary view of an enlarged portion of the structure shown in FIG. 1.

As best seen in FIG. 3 the bottom gate section 26 is fixedly coupled to the frame 12, and the top gate section 24 is pivotally moveable by a hinge 36 relative to the bottom gate section 26 between open and closed positions so as to allow access to a child within the upper crib 18. In its open position, the top gate section 24 is pivoted laterally outwardly, relative to the interior of the upper crib 18, and downwardly toward the bottom gate section 26 in the direction of arrow "A" of FIG. 2. When fully pivoted to its open position, the top gate section 24 seats against the bottom gate section 26 to provide access to a child in the crib 18. In obtaining its closed position, the top gate section 24 is pivoted upwardly and is locked in position by slide locks 72. Flanges 70 prevent the top gate section 24 from moving into the interior of the upper crib 18.

The lower crib 20, as shown in FIGS. 1 and 2, is a moveable crib comprising its own side sections 52, backside 54 and floor 56, as well a front side gate section 58 formed of fixed, equally spaced slats 60. The lower crib 20 is supported upon a traditional caster 66 at each of its four corners so that the lower crib 20 is moveable into and out of an opening 64, thereby enabling the lower crib 20 to be repositioned according to the need or desire of a caretaker. As also shown in FIG. 2, the lower crib 20 accommodates a mattress or pad (not shown) so as to accommodate a child therewithin.

Referring again to FIGS. 1 and 2, it can be seen that lower crib 20 is stackable relative to upper crib 18 so as to be nestable within the opening 64 of frame 12. The lower crib is freely moveable into and out of the opening 64 (as shown by Arrow B) in FIG. 2 on the casters 66 provided at the four lower corners of the lower crib 20 so as to allow overhead access to a child therein when necessary. The lower crib 20 can be positioned within the opening 64 beneath the upper crib 18 when access to the child is not required.

It should be apparent a crib set of the present invention has been provided enabling access to a child within a respective crib thereof without the use of drop-side gating so as to avoid concerns associated with such use. Further, there is provided a crib set enabling use of a stationary and moveable crib that are positioned one beneath the other to minimize space requirements where multiple infants are cared for such as in day care centers and the like.

What is claimed is:

1. A crib set, comprising:

a frame;

an upper crib and a lower crib housed within said frame, said frame providing an opening below said upper crib to accommodate said lower crib;

said upper crib being stationary with respect to and formed in part by said frame;

said lower crib being moveable into and out of said frame and including casters provided for said lower crib to enable said lower crib to be moved into and out of said opening in said frame.

2. The crib set as defined in claim 1 and in which said upper crib comprises a front;

said front being formed of a lower section and an upper section; and said upper section being foldable away from the interior of said upper crib to provide access to said interior.

3. A crib set, comprising:

a frame;

an upper crib and a lower crib housed within said frame;

said upper crib being stationary with respect to and formed in part by said frame, and said upper crib comprising a front, said front being formed of a lower section and an upper section, said upper section being foldable away from the interior of said upper crib to provide access to said interior, and a hinge connecting said upper section and said lower section of said front; and said lower crib being moveable into and out of said frame.

4. The crib set as defined in claim 3 and in which said upper crib and said lower crib are positionable with the upper crib above said lower crib.

5. The crib set as defined in claim 3 and in which said frame provides an opening below said upper crib to accommodate said lower crib.

* * * * *